US007047568B2

(12) United States Patent
Hofmann

(10) Patent No.: US 7,047,568 B2
(45) Date of Patent: May 23, 2006

(54) TWO-PART PROTECTIVE SUIT WITH CONNECTING SECTION

(75) Inventor: Marianne Hofmann, Duesseldorf (DE)

(73) Assignee: Blücher GmbH, Erkrath (DE)

( * ) Notice: Subject to any disclaimer, the term of this patent is extended or adjusted under 35 U.S.C. 154(b) by 65 days.

(21) Appl. No.: 10/877,994

(22) Filed: Jun. 29, 2004

(65) Prior Publication Data

US 2005/0044605 A1 Mar. 3, 2005

(30) Foreign Application Priority Data

Jul. 11, 2003 (DE) ..... 103 31 724
Jul. 30, 2003 (DE) ..... 103 34 667

(51) Int. Cl.
*A41D 15/00* (2006.01)

(52) U.S. Cl. ..... 2/70

(58) Field of Classification Search ..... 2/79, 2/227, 70, 71, 94, 114, 115, 69, 86, 250, 108
See application file for complete search history.

(56) References Cited

U.S. PATENT DOCUMENTS 2,130,690 A 9/1938 Lemoine
4,390,996 A * 7/1983 Read ..... 2/70
5,182,812 A * 2/1993 Goldsby ..... 2/79
5,343,564 A * 9/1994 Reynolds et al. ..... 2/70
6,108,815 A * 8/2000 Majerfeld ..... 2/71

FOREIGN PATENT DOCUMENTS

| | | |
|---|---|---|
| DE | 666 691 | 9/1938 |
| DE | 195 19 869 A1 | 12/1996 |
| DE | 101 54 029 A1 | 5/2003 |
| DE | 600 01 104 T2 | 11/2003 |
| EP | 1 152 670 B1 | 1/2003 |

* cited by examiner

*Primary Examiner*—Tejash Patel
(74) *Attorney, Agent, or Firm*—David S. Safran

(57) ABSTRACT

A two-part protective suit, especially for protective purposes and/or for military purposes, such as a NBC protective suit or the like, with a jacket and trousers, the jacket having a peripheral edge which overlaps the trousers and is able to be joined to the trousers. The jacket also has a peripheral connecting section which is joined to the jacket, above the jacket edge, i.e., spaced away from the jacket edge, the connecting section and the trousers having a connecting element so that the connecting section can be joined to the trousers for sealed connection of the jacket to trousers.

29 Claims, 5 Drawing Sheets

TWO-PART PROTECTIVE SUIT WITH CONNECTING SECTION

BACKGROUND OF THE INVENTION

1. Field of the Invention

This invention relates to a protective suit, especially for protective or military purposes, for example, an NBC protective suit or the like. In particular, this invention relates to a protective suit which is made in two parts, with a top part, especially a jacket, and a bottom part, especially trousers.

2. Description of Related Art

There is a series of substances which are absorbed by the skin and which lead to serious physical injury. Examples are the blistering mustard gas (yellow cross) and the nerve agent Sarin. Individuals who can come into contact with these poisons must wear a special protective suit or must be protected against these poisons by suitable protective materials.

Basically, there are three types of protective suits: Airtight and water vapor-impermeable protective suits, which are provided with a rubber layer which is impermeable to chemical poisons, and which lead very quickly to accumulation of heat. Furthermore, there are air-permeable and water vapor-permeable protective suits which offer the greatest wearing comfort, and finally protective suits which are provided with a membrane which does pass water vapor, but not the aforementioned poisons.

Protective suits against chemical warfare agents which are intended for longer use under the most varied conditions must not lead to heat accumulation for the wearer. Therefore, mainly air-permeable materials are used for these purposes.

The permeable protective suits which are porous to air generally have an adsorption layer with activated carbon which binds the chemical poisons very stably, so that there is no danger at all to the user even from highly contaminated protective suits. The major advantage of these protective suits is that the activated carbon is also accessible on the inside so that poisons which have penetrated at damage sites or other leaks can be very quickly adsorbed. The adsorption layer in the above described permeable, air-porous protective suits is made in most cases such that either on average up to roughly 1.0 mm activated carbon grains, especially activated carbons spherules, are bonded to an adhesive mass which has been pressed onto a carrier, or however, a reticulated PU foam which is impregnated with "carbon paste" (i.e. binder and activated carbon) is used as the absorption layer, generally a cover material being added to the adsorption layer and the layer being covered by a light textile material on the inside facing the wearer. Furthermore, there are also composites which contain activated carbon surface structures.

Additionally, protective suits can be used which are provided with a membrane which is made permeable to water vapor to increase the comfort of wearing, but at the same time acts as a barrier layer against liquids, especially poisons.

Finally, protective suits are also used which combine an adsorption layer which contains activated carbon and a membrane.

In general, the above described protective suits can be made in one part, especially in the form of overalls, but also in two parts, i.e., as a suit consisting of a jacket and trousers. Protective suits in the form of overalls compared to the two-part protective suits have the advantage that they do not have a transition from the jacket and trousers which entails the danger that toxic substances can penetrate through this transition and can come into contact with the wearer of the protective suit. Also dirt, dust and sand under extreme conditions of use can penetrate via this transition between the jacket and trousers and foul the protective suit from the inside and in this way reduce the comfort of wearing.

On the other hand, protective suits made in two parts from a top part, especially a jacket, and a bottom part, especially trousers, have the decisive advantage of improved comfort of wearing compared to protective overalls. In particular, the top part can be opened outside of use; this contributes decisively to wearing comfort, especial to preventing the accumulation of heat.

SUMMARY OF THE INVENTION

A primary object of the present invention is provide a two-part protective suit, especially for protective and military purposes, for example, a NBC protective suit or the like, which avoids the above described problems—at least in part. In particular one object of this invention, in a two part protective suit consisting of a top part, especially a jacket, and a bottom part, especially trousers, is to make the transition between the top part on the one hand and the bottom part on the other such that better sealing of this transition is ensured.

The above described object is achieved in accordance with the invention by a protective suit, especially for protective and military purposes, for example, a NBC protective suit or the like, with a top part, especially a jacket, and a bottom part, especially trousers, the top part having a peripheral edge which can overlap or does overlap the bottom part, and can be joined to the bottom part, the top part having a peripheral connecting section which is connected or can be connected to the top part above the edge (i.e., spaced from the edge), the connecting section and/or the bottom part having a connecting means so that the connecting section can be joined to the bottom part for sealed connection of the top part and bottom part.

The basic idea of this invention is thus to provide the top part with a peripheral connecting section which can be joined to the bottom part so that the transition between the top part, on the one hand, and the bottom part, on the other hand, is improved, especially is better sealed. Advantageously, the connecting section can be detachably joined to the bottom part.

The protective suit which is made in two parts in accordance with the invention, in addition to increased wearing comfort as compared to a one-piece protective suit, moreover, offers the decisive advantage that the transition from the top part and the bottom part when being worn, i.e., when the connecting section is joined to the bottom part, is efficiently sealed. In this way, dust, sand or dirt or chemical warfare agents are prevented from reaching the body of the wearer of such a protective suit between the top part and the bottom part because this is prevented by the connecting section which is provided of the invention. This is especially advantageous when the suit is worn under extreme conditions, for example, in deployments in desert regions, where the protective suit is exposed to extreme demands, especially in the case of a sandstorm.

It is especially advantageous if the connecting section is made to deflect the wind. In addition, it can be equally advantageous to provide the connecting section with an adsorbent material, especially activated carbon, preferably in the form of activated carbon grains or spherules or activated carbon fibers, in order to efficiently adsorb chemical warfare agents which may have penetrated between the top part and bottom part.

Other advantages, properties, aspects and features of this invention follow from the following description of a preferred embodiment in conjunction with accompanying drawings.

DETAILED DESCRIPTION OF THE INVENTION

Figure 1:
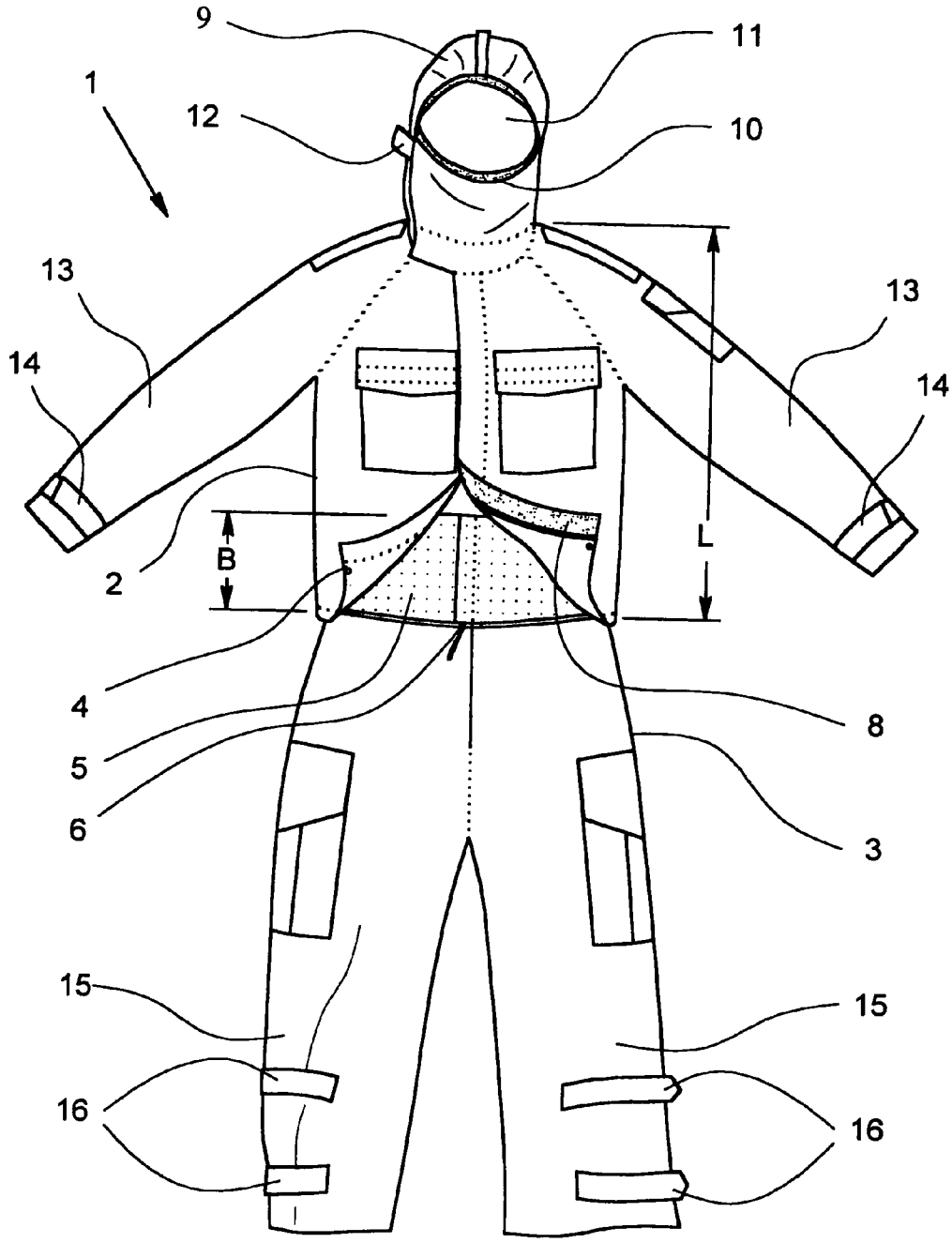
FIG. 1 is a schematic front view of a protective suit in accordance with the invention with a top part which is partially opened in the hip area, so that the connecting section is visible in the closed state.
Figure 2:
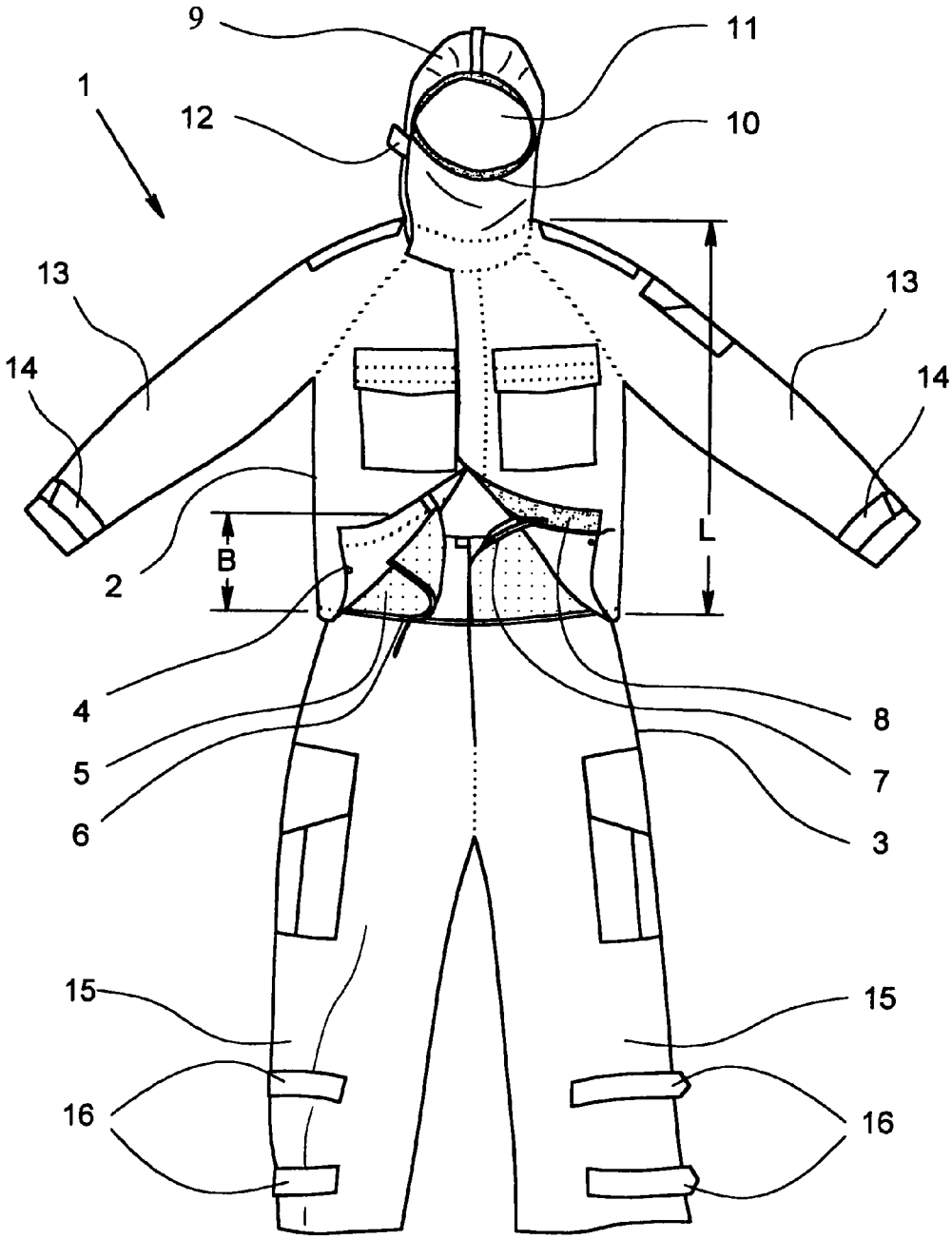
FIG. 2 is a schematic front view of the protective suit of FIG. 1 with a top part which is partially opened in the hip area, so that the connecting section is visible in the partially opened state.

FIGS. 1 & 2 show a protective suit 1 in accordance with the invention, especially for protective and/or military purposes, such as a NBC protective suit or the like, with a top part 2, especially a jacket, and a bottom part 3, especially trousers. The top part 2 has a peripheral edge 4 which can overlap the bottom part 3, and can be joined to the bottom part 3. The top part 2 has a peripheral connecting section 5 which can be connected to the top part 2 above the edge 4, i.e., at a distance from the edge 4, the connecting section 5 and/or the bottom part 3 having a connecting means 6 so that the connecting section 5 can be joined to the bottom part 3 for sealed connection of the top part 2 and bottom part 3. Advantageously, the connecting section 5 can be detachably joined to the bottom part 3.

One of the particulars of this invention is that the protective suit 1 of the invention has a connecting section 5 on its top part 2 that is a separate, additional element independent of the jacket hem, in the manner of peripheral edging which is a component of the top part 2 and is joined to the top part 2 and can be preferably detachably joined to the bottom part 3. In this way, efficient sealing of the transition from the top part 2 and bottom part 3 is achieved so that, even under extreme conditions of use (for example, in desert regions), no dirt, sand, dust nor any chemical warfare agents which end up between the top part 2 and the bottom part 3 can reach the body of the wearer of such a protective suit.

As was explained above, the top part 2 can preferably be detachably joined to the bottom part 3 via the connecting section 5 by a connecting means 6. However, fundamentally, it is also possible to accomplish sealing of the transition by a frictionally engaged connection between the connecting section 5 and/or the bottom part 3, i.e., without the connecting means 6. Still it is preferred that a connecting means 6 be provided for this purpose because this ensures a reliable, sealed connection.

Figure 4A:
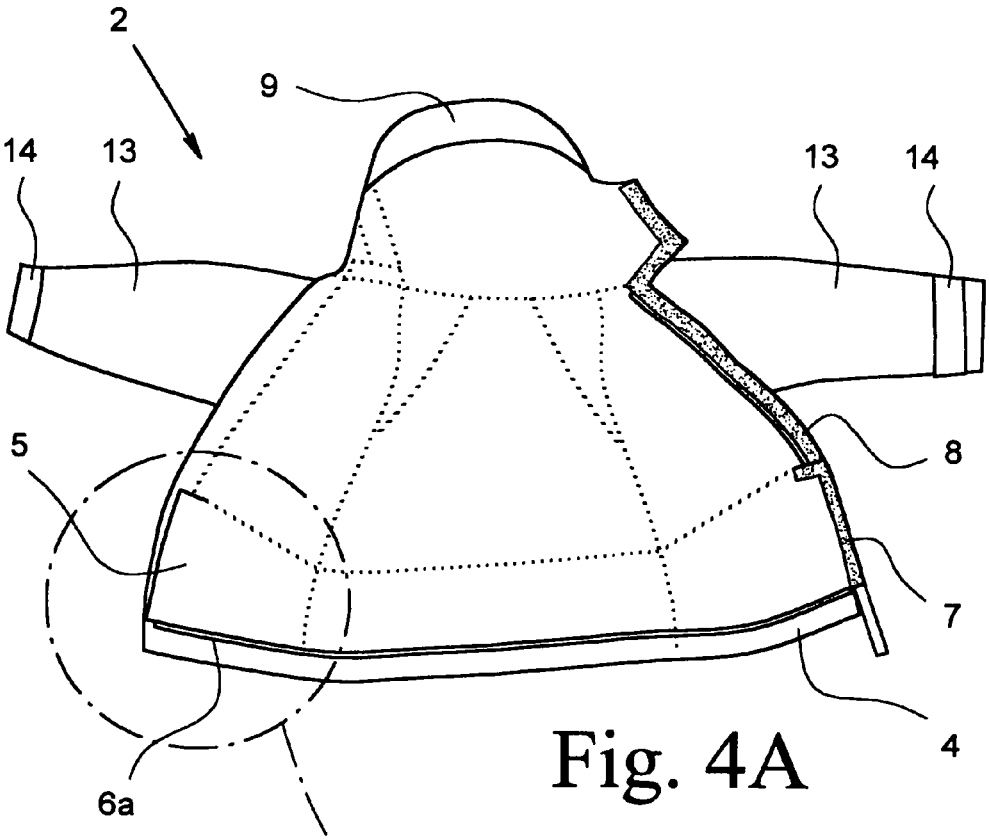
FIG. 4A is a schematic front view of the top part of the protective suit of FIG. 1.
Figure 4B:
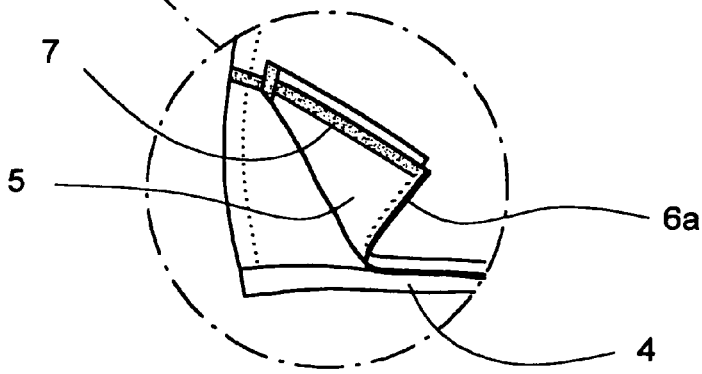
FIG. 4B shows an enlargement of the area encircled by a dot-dash line in FIG. 4A.

As is apparent from FIGS. 4A and 4B, the connecting section 5, especially on its top part or area, preferably on its top edge, can be stably connected to the top part 2, especially by sewing, weaving, cementing, stitching, bonding, or the like. Advantageously, as FIG. 4A shows, the connecting section 5 is peripherally connected to the top part 2.

According to its function of preventing the penetration of dirt, sand, dust and chemical warfare agents into the transition from the top part 2 and the bottom part 3 and to seal the transition from the top part 2 and the bottom part 3, it is advantageous if the connection of the connecting section 5 to the top part 2 is spaced from the edge 4 at a distance of roughly ⅛ to ⅓, especially roughly ⅙ to roughly ¼, the top part 2. For example, the connecting section 5 can be located roughly at the height of the lower third, especially the lower fourth, of the top part 2.

According to the function of the peripheral connecting section 5, it is advantageous if the connecting element 6 is also made peripheral. For example, the connecting element 6 can run along the lower edge of the connecting section 5 and/or along the upper edge of the bottom part 3. For example, the connecting element 6 can have a first connecting part 6*a* which is attached to the connecting section 5, and a second connecting part 6*b* which is attached to the bottom part 3, and the first and the second connecting parts 6*a*, 6*b* can be joined to one another, especially detachably joined. The connecting element 6 can be, for example, a zipper, a VELCRO® hook and loop closure, a button closure or the like. Basically, any connecting element is possible which ensures efficient connection or connectability between the connecting section 5 and the bottom part 3. Advantageously, a detachable connecting means, as described above, is used. As mentioned above, the connection or connectability between the connecting section 5 and the bottom part 3 can also be accomplished by frictional engagement without a connecting element 6, but due to the improved sealing function, it is preferred that there is a connecting element 6 on the connecting section 5 and/or on the bottom part 3.

As is apparent from FIGS. 4A & 4B, the connecting section 5 is generally located or attached on the inside of the top part 2. Basically however, it is also possible to arrange or attach the connecting section 5 on the outside on the top part 2. But, the inside arrangement or attachment is preferred because in the state of being worn with the top part 2 closed the connecting section 5 is covered so that contaminants cannot reach the connecting section 5, especially not the connecting means 6.

Figure 3:
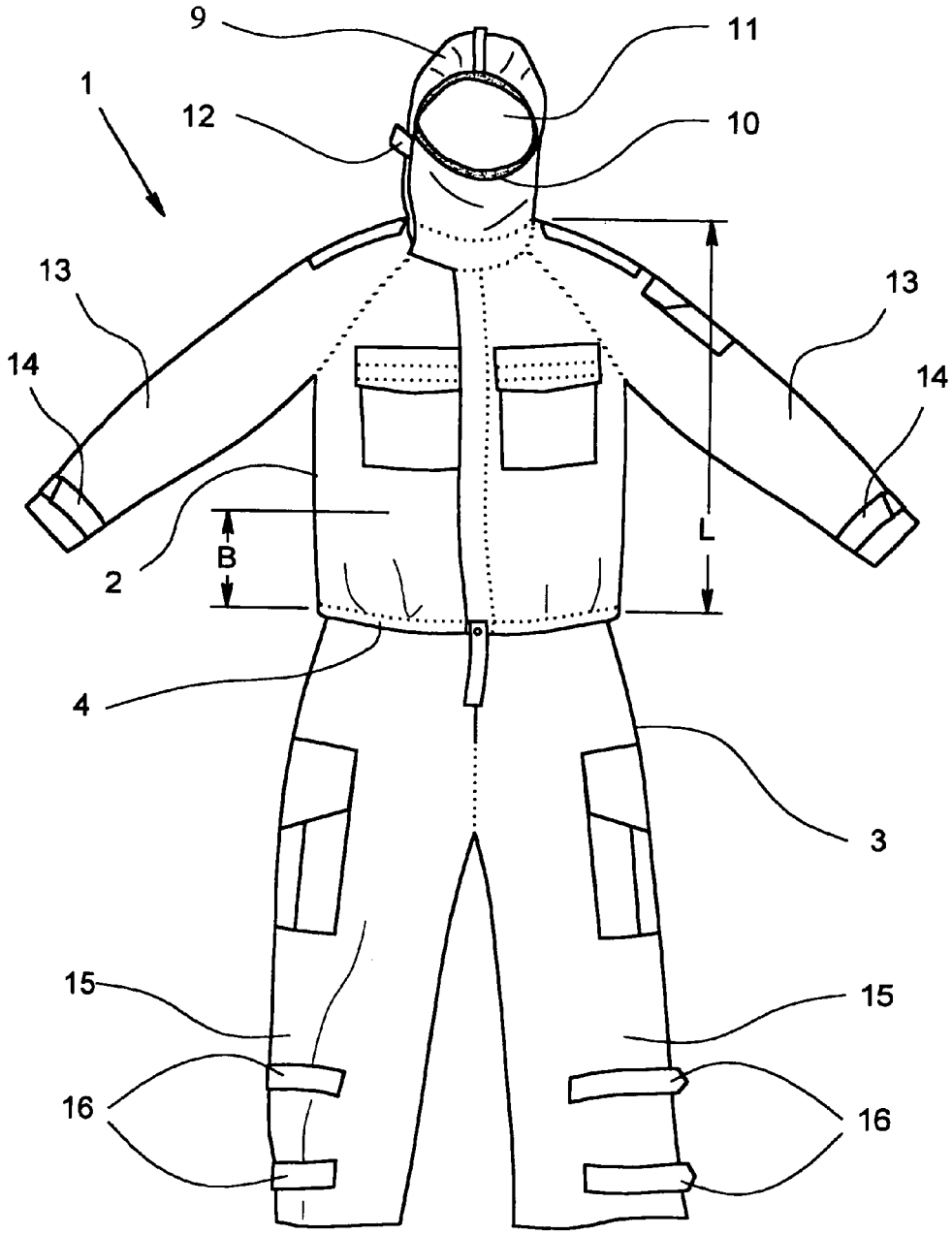
FIG. 3 is a schematic front view of the protective suit of FIG. 1 in the closed state, especially with the top part closed so that the connecting section is completely covered.

According to one special embodiment, the connecting section 5 ends flush with the edge 4 of the top part 2 or is preferably made even shorter than the top part 2, i.e., preferably, the edge 4 of the top part 2 projects beyond the connecting section 5 so that the connecting section 5, with the top part 2 closed while being worn, is completely covered or overlapped by the top part 2, as is apparent from FIG. 3. In this way, improved sealing is accomplished, and moreover, the connecting means 6 is not exposed to contaminants.

As FIG. 4A shows, the peripheral connecting section 5 advantageously extends over the entire periphery of the top part 2, i.e., the connecting section 5 is made extend over the entire periphery of the top part 2; this leads to an efficient sealing function.

For an efficient sealing function, it is advantageous if—as shown in FIGS. 1 and 2—the width B of the connecting section 5 comprises at least roughly one sixth, especially at least roughly one fifth, preferably at least roughly one fourth, of the torso length L of the top part 2.

As is apparent from FIGS. 4A & 4B and from FIG. 2, the connecting section 5 is advantageously is openable independently of the top part 2. This leads to improved wearing comfort and improved functionality because the top part 2 can be independently opened, and in this way, can provide the desired air supply for the wearer.

For this purpose, as is apparent especially from FIGS. 4A & 4B, the connecting section 5 has a closure 7 for front opening and closing of the connecting section 5, for example, a closure 7 in the form of a zipper, a VELCRO® hook and loop closure, a button closure or the like. For reasons of functionality, it is advantageous if the closure 7 of the connecting section 5 is made at least essentially corresponding to the top part 2, i.e., in other words, is at least essentially parallel to the closure means 8 of the top part 2 and is aligned at least essentially vertically when being worn. Advantageously, when being worn, the closure elements 7, 8 of the connecting section 5 and of the top part 2 lie essentially on top of one another. Outfitting the connecting section 5 with a separate closure 7 enables complete opening of the top part 2 when not in use for protective purposes.

To increase the functionality of the connecting section 5 provided in accordance with the invention, especially to prevent chemical warfare agents which may have penetrated into the transition from the top part 2 and the bottom part 3 from being able to come into contact with the body of the wearer of this protective suit 1, it is advantageous to provide the connecting section 5, especially on the inside or on the sides facing the wearer when being worn, with an adsorptive material (for example, activated carbon, preferably in the form of activated carbon grains or spherules and/or activated carbon fibers) and/or with a water vapor-permeable blocking layer which is at least essentially impermeable to gas and air, especially a membrane, which prevents or at least delays the passage of toxic gases or liquids, especially chemical warfare agents. For example, the connecting section 5, especially on the inside or the side facing the wearer, can be provided completely or at least partially with an inner material which comprises an adsorptive material as was described above, and/or a water vapor-permeable blocking layer which is at least essentially impermeable to gas and air, especially a membrane, which prevents or at least delays the passage of toxic gases or liquids, especially chemical warfare agents.

Furthermore, the functionality of the connecting section 5 that is provided in accordance with the invention can also be increased by the connecting section 5 being made wind-deflecting. For example, for this purpose, the connecting section 5, especially on the outside or on the side facing away from the wearer, can be provided with a wind-deflecting, especially an at least essentially air-impermeable material. For example, on the connecting section 5, especially on the outside or the side facing away from the wearer, a wind-deflecting, especially an at least essentially air-impermeable material can be applied (for example, a plastic material, a wax, an oleophobic and/or hydrophobic coating, etc).

To achieve an improved protective action against chemical poisons, especially chemical warfare agents, it is advantageous if the top part 2 and/or the bottom part 3, especially on the inside or on the side facing the wearer, have an adsorptive material (for example, activated carbon, preferably in the form of activated carbon grains or spherules and/or activated carbon fibers) and/or a water vapor-permeable blocking layer which is at least essentially impermeable to gas and air, especially a membrane, which prevents or at least delays the passage of toxic gases or liquids, especially chemical warfare agents. For example, the top part 2 and/or the bottom part 3 for this purpose, especially on the inside, can be provided completely or at least partially with a corresponding inner material.

To achieve an improved protective action, it can also be advantageous to provide the top part 2 and/or the bottom part 3, especially on the outside or on the side facing away from the wearer, with a hydrophobic and/or oleophobic coating or impregnation. This leads to chemical poisons, especially chemical warfare agents, when they occur in larger concentrations in droplet form or as a condensate, being repelled from the top part 2 and the bottom part 3, i.e., therefore, so to speak, more or less "beading off".

As shown by FIGS. 1, 2, 3, 4A and 4B, to increase the functionality, especially the protective action, the top part 2 can be provided with a hood 9. FIGS. 1, 2, and 3 show that the hood 9 has a peripheral elastic hem 10 for forming a visual field opening 11, the visual field opening 11 being intended especially for holding a respirator (not shown) and the hem 10 in use adjoining the respirator. The hood 9 including the visual field opening 11, especially on the side part of the visual field opening, can have a closure 12, especially in the form of a VELCRO® hook and loop closure, a zipper, or the like. According to one special embodiment the hood 9 can be made to be removable from the remaining top part 2. Advantageously the hood 9, especially on the inside, is provided with an adsorbent material, as described above, and/or with a water vapor-permeable blocking layer which is at least essentially impermeable to gas and air, especially a membrane, as described above, so that protection against chemical poisons, especially chemical warfare agents, is also ensured in the region of the head.

As is apparent from FIGS. 1–3, the top part 2, especially in the area of each of the sleeves 13, can be provided with at least one adjustment element, especially in the form of a VELCRO® hook and loop closure element, in order to enable constriction or adaptation of the sleeve 13 to the periphery of the extremity, in areas, and adjustability of width of the sleeve 13. A corresponding version can also be provided for the bottom part 3, especially in the area of the trouser legs 15, which can each be provided with at least one adjustment element 16, especially in the form of a VELCRO® hook and loop closure element, in order to enable, in areas, constriction or adaptation of the trouser leg 15 to the periphery of the extremity, or adjustability of the width of the trouser leg 15.

In addition to the adjustment element 14, another supplementary adjustment element (not shown), especially in the form of a zipper, can be provided in the area of the sleeve 13 or in the area of the adjustment element 14 which enables more extensive or additional constriction or adaptation of the sleeve 13 to the periphery of the extremity or more extensive or additional adjustability of the width of the sleeve 13, and thus, improves and optimizes this adaptation or adjustability so that still better sealing is achieved, and moreover, wrinkling is counteracted. A corresponding version can also be provided for the bottom part 3 in the area of the trouser legs 15 or in the area of the adjustment element 16 in order to enable more extensive or additional constriction or adaptation of the trouser leg 15 to the periphery of the extremity or more extensive or additional adjustability of the width of the trouser leg 15 for the aforementioned purposes.

Figure 5:
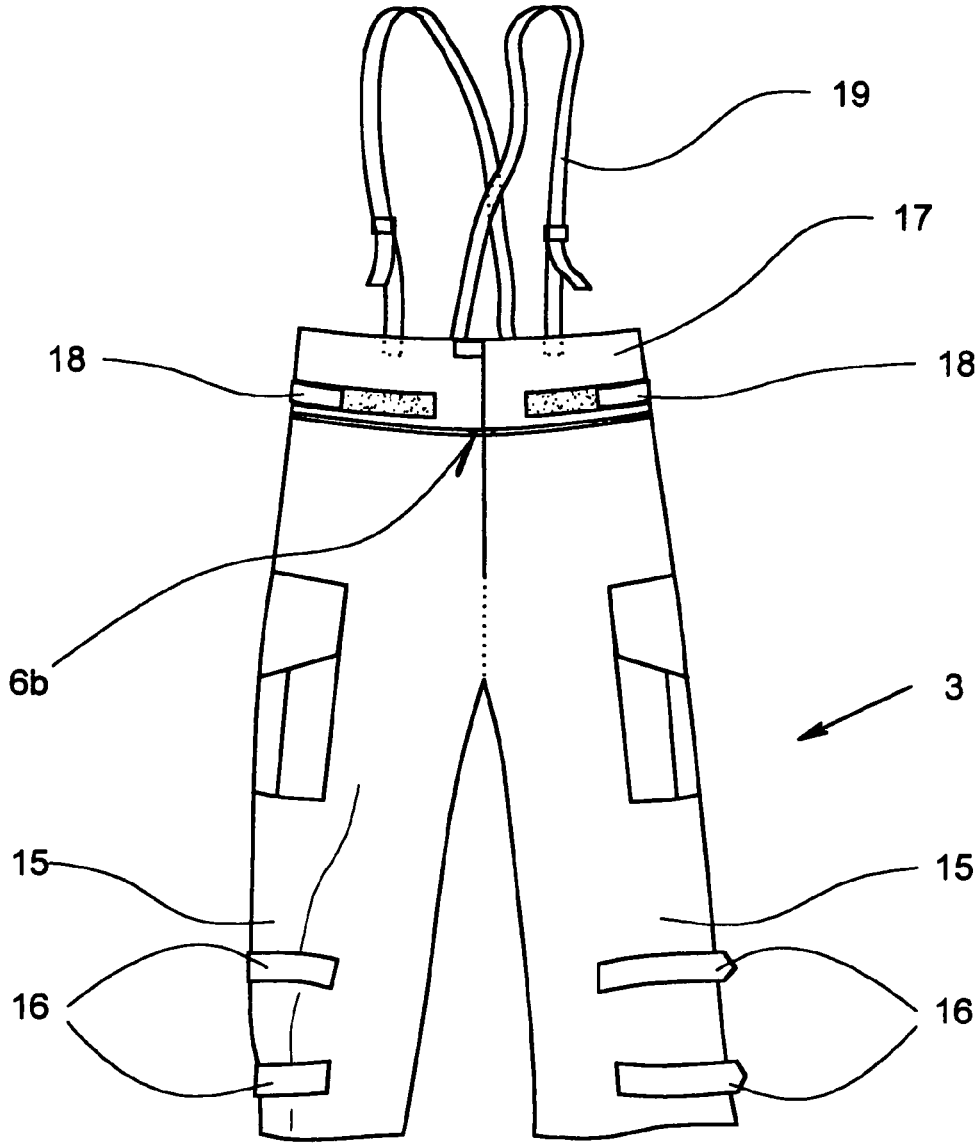
FIG. 5 is a schematic front view of the bottom part of the protective suit of FIG. 1.

As is apparent from FIG. 5, the bottom part 3 can be additionally provided, especially in the area of the waistband 17, with at least one adjustment element 18, especially in the form of a VELCRO® hook and loop closure element, which enables constriction or adaptation of the waistband 17 to the periphery of the torso or adjustability of the width of the waistband 17. Moreover the bottom part 3 can additionally be provided with suspenders 19.

Other embodiments, modifications and variations of this invention can be easily recognized and implemented for one skilled in the art in the reading of the specification without departing from the scope of this invention.

What is claimed is:

1. A protective suit, comprising a jacket and trousers, the jacket having a peripheral edge which overlaps the trousers and is connectable to the trousers, wherein the jacket additionally has a peripheral connecting section which is joined to the jacket at a distance from a bottom edge of the jacket, the connecting section and the trousers having a connecting means for joining the connecting section to the trousers for sealed connection of the jacket and trousers; wherein the connecting section has an activated carbon based adsorptive material therein.

2. Protective suit as claimed in claim 1, wherein the connecting section is detachably joined to the trousers.

3. Protective suit as claimed in claim 1, wherein the connecting section is fixedly joined to the jacket extending peripherally around an inner side thereof.

4. Protective suit as claimed in claim 1, wherein connection of the connecting section to the jacket is spaced from the lower edge of the jacket at a distance equal to about ⅛ to about ⅓ of the torso length of the jacket.

5. Protective suit as claimed in claim 1, wherein the connecting means runs along a lower edge of the connecting section and an upper edge of the trousers.

6. Protective suit as claimed in claim 1, wherein the connecting means has a first connecting part which is attached to the connecting section and a second connecting part which is attached to the trousers, the first connecting part and the second connecting part being detachably connectable to one another.

7. Protective suit as claimed in claim 1, wherein the connecting section is attached to the inside of the jacket.

8. Protective suit as claimed in claim 1, wherein the connecting section ends flush with the lower edge of the jacket.

9. Protective suit as claimed in claim 1, wherein the connecting section is shorter than the jacket.

10. Protective suit as claimed in claim 1, wherein the connecting section extends around the entire inner periphery of the jacket.

11. Protective suit as claimed in claim 1, wherein the width of the connecting section amounts to at least about one sixth of the torso length of the jacket.

12. Protective suit as claimed in claim 1, wherein the connecting section has a closure for opening and closing of the connecting section which enables the connecting section to be opened independently of the jacket.

13. Protective suit as claimed in claim 1, wherein the connecting section is able to deflect wind.

14. Protective suit as claimed in claim 13, wherein the connecting section is provided with a wind-deflecting material which is impermeable to air on an outer side thereof.

15. A protective suit comprising a jacket and trousers, the jacket having a peripheral edge which overlaps the trousers and is connectable to the trousers, wherein the jacket additionally has a peripheral connecting section which is joined to the jacket, spaced away from a lower edge of the jacket and extending around the entire inner periphery of the jacket, the connecting section being made to repel wind and having an activated carbon based adsorptive material therein, and wherein the connecting section and the trousers have a connecting means for joining the connecting section to the trousers for producing a sealed connection of the jacket to the trousers.

16. Protective suit as claimed in claim 15, wherein the connecting section has a closure for opening and closing of the connecting section so that the connecting section can be opened independently of the jacket.

17. A protective suit, comprising a jacket and trousers, the jacket having a peripheral edge which overlaps the trousers and connectable to the trousers, wherein the jacket additionally has a peripheral connecting section which is joined to the jacket, spaced away from a lower edge of the jacket, the connecting section being connectable to the trousers for sealed connection of the jacket to the trousers, wherein the connecting section has a closure for opening and closing of the connecting section so that the connecting section can be opened independently of the jacket, and wherein the connecting section is wind deflectable and has an activated carbon based adsorptive material therein.

18. A protective suit, comprising a jacket and trousers, the jacket having a peripheral edge which overlaps the trousers and is connectable to the trousers, wherein the jacket additionally has peripheral connecting section which is joined to the jacket at a distance from a bottom edge of the jacket, the connecting section and the trousers having a connecting means for joining the connecting section to the trousers for sealed connection of the jacket and trousers, wherein the connecting section is able to deflect wind, the connecting section being provided with a wind-deflecting material which is impermeable to air on an outer side thereof.

19. Protective suit as claimed in claim 18, wherein the connecting section is detachably joined to the trousers.

20. Protective suit as claimed in claim 18, wherein the connecting section is fixedly joined to the jacket extending peripherally around an inner side thereof.

21. Protective suit as claimed in claim 18, wherein connection of the connecting section to the jacket is spaced from the lower edge of the jacket at a distance equal to about ⅛ to about ⅓ of the torso length of the jacket.

22. Protective suit as claimed in claim 18, wherein the connecting means runs along a lower edge of the connecting section and an upper edge of the trousers.

23. Protective suit as claimed in claim 18, wherein the connecting means has a first connecting part which is attached to the connecting section and a second connecting part which is attached to the trousers, the first connecting part and the second connecting part being detachably connectable to one another.

24. Protective suit as claimed in claim 18, wherein the connecting section is attached to the inside of the jacket.

25. Protective suit as claimed in claim 18, wherein the connecting section ends flush with the lower edge of the jacket.

26. Protective suit as claimed in claim 18, wherein the connecting section is shorter than the jacket.

27. Protective suit as claimed in claim 18, wherein the connecting section extends around the entire inner periphery of the jacket.

28. Protective suit as claimed in claim 18, wherein the width of the connecting section amounts to at least about one sixth of the torso length of the jacket.

29. Protective suit as claimed in claim 18, wherein the connecting section has a closure for opening and closing of the connecting section which enables the connecting section to be opened independently of the jacket.

* * * * *